US007025435B2

(12) United States Patent
Kim

(10) Patent No.: US 7,025,435 B2
(45) Date of Patent: Apr. 11, 2006

(54) METHOD AND APPARATUS FOR CALIBRATING IMAGE ALIGNMENT ERRORS

(75) Inventor: Tae-young Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 234 days.

(21) Appl. No.: 10/771,501

(22) Filed: Feb. 5, 2004

(65) Prior Publication Data

US 2004/0223023 A1 Nov. 11, 2004

(30) Foreign Application Priority Data

Feb. 15, 2003 (KR) ..... 10-2003-0009604

(51) Int. Cl.
*B41J 29/393* (2006.01)

(52) U.S. Cl. ..... 347/19

(58) Field of Classification Search ..... 347/19, 347/37

See application file for complete search history.

(56) References Cited

U.S. PATENT DOCUMENTS 6,353,481 B1 * 3/2002 Lee ..... 358/1.14
6,607,260 B1 * 8/2003 Ikeda ..... 347/19
6,727,932 B1 * 4/2004 Enomoto et al. ..... 347/188

* cited by examiner

*Primary Examiner*—K. Feggins
*Assistant Examiner*—Rene Garcia, Jr.
(74) *Attorney, Agent, or Firm*—Staas & Halsey LLP

(57) ABSTRACT

A method and apparatus for calibrating image alignment errors is provided. The method includes printing a horizontal reference line having the length obtained by adding a first horizontal comparison line and a second horizontal comparison line, calibrating the length of the horizontal reference line, printing the first horizontal comparison line, printing the second horizontal comparison line on the same horizontal line as the first horizontal comparison line, calibrating the length of a horizontal comparison line from one end of the first horizontal comparison line printed to one end of the second horizontal comparison line printed, and subtracting the length of the horizontal comparison line from the length of the horizontal reference line.

24 Claims, 6 Drawing Sheets

METHOD AND APPARATUS FOR CALIBRATING IMAGE ALIGNMENT ERRORS

CROSS-REFERENCE TO RELATED APPLICATIONS

This application claims the priority of Korean Patent Application No. 2003-9604, filed on Feb. 15, 2003, in the Korean Intellectual Property Office, the disclosure of which is incorporated herein in its entirety by reference.

BACKGROUND OF THE INVENTION

1. Field of the Invention

The present invention relates to the printing of an image in an ink-jet printer, and more particularly, to a method and apparatus for calibrating errors in image alignment on a horizontal or vertical axis.

2. Description of the Related Art

Ink-jet printers have a printhead, which is mounted on a movable carriage. When the carriage is moved in one or two directions, ink is ejected from the printhead, thus printing an image line by line. Images printed line by line collectively form the full desired image. Some inkjet printers have a plurality of printheads that operate in a similar fashion.

The quality of the full image is determined according to the number of mechanical errors. The mechanical errors cause an improper printing operation due to different horizontal or vertical printheads. In addition, the mechanical errors continuously cause printing errors according to the position of a distorted hole of the printhead.

The mechanical errors are generated due to a great variety of factors, such as curvature of a printhead, the ejection shape of different nozzles, the position of the printheads of different cartridges, and the difference in speed between printheads. In addition, speed variation and the direction of movement of a cartridge cause nonuniformity of an ink falling time.

Conventionally, a plurality of test marks are provided such that a user can check in advance the state of alignment of images to correct errors. In other words, in order to correct errors in the image alignment, a plurality of test marks are printed. The test marks are divided into test mark patterns to check an alignment state on a horizontal axis and test mark patterns to check an alignment state on a vertical axis. The user selects a test mark, an alignment state of which is the best, from the plurality of printed test marks. Then, the ink-jet printer performs a correction operation, such as selecting a printing starting position, an ink ejection speed, or ink nozzles that are most suitable for image printing. In addition, an ink-jet printer that calibrates errors of test marks automatically has been recently used.

However, the user should check the plurality of test marks to detect the alignment state of the test marks. Because this operation is performed with the naked eye, it is time consuming and the user easily gets tired. Also, there is the possibility for the user to select improper test marks. In addition, error detection is complicated even in an ink-jet printer for automatically detecting errors of test marks.

SUMMARY OF THE INVENTION

Additional aspects and/or advantages of the invention will be set forth in part in the description which follows and, in part, will be obvious from the description, or may be learned by practice of the invention.

The present invention provides a method of calibrating image alignment errors automatically, by which errors in image alignment are easily calibrated.

The present invention also provides an apparatus for calibrating image alignment errors automatically, which easily calibrates errors in image alignment.

According to an aspect of the present invention, a method of calibrating image alignment errors performed by an ink-jet printer, to correct errors in image alignment on a horizontal or vertical axis includes printing a horizontal reference line having the length obtained by adding a first horizontal comparison line and a second horizontal comparison line together, calibrating the length of the horizontal reference line, printing the first horizontal comparison line, printing the second horizontal comparison line on the same horizontal line as the first horizontal comparison line, calibrating the length of a horizontal comparison line from one end of the first horizontal comparison line printed to one end of the second horizontal comparison line printed, and subtracting the length of the horizontal comparison line from the length of the horizontal reference line.

According to another aspect of the present invention, a method of calibrating image alignment errors performed by an ink-jet printer, so as to correct errors in image alignment on a horizontal or vertical axis includes printing a vertical reference line having the length obtained by adding a first vertical comparison line and a second vertical comparison line together, calibrating the length of the vertical reference line, printing the first vertical comparison line, printing the second vertical comparison line on the same vertical line as the first vertical comparison line, calibrating the length of a vertical comparison line from one end of the first vertical comparison line printed to one end of the second vertical comparison line printed, and subtracting the length of the vertical comparison line from the length of the vertical reference line.

According to another aspect of the present invention, an apparatus calibrating image alignment errors performed by an ink-jet printer, so as to correct errors in image alignment on a horizontal or vertical axis, includes a printing unit, a reference line printing instruction unit, a reference line length calibration unit, a first comparison line printing instruction unit, a second comparison line printing instruction unit, a comparison line length calibration unit, and a length subtraction unit. The printing unit prints one of a first horizontal comparison line, a second horizontal comparison line, a first vertical comparison line, a second vertical comparison line, a horizontal reference line having the length obtained by adding the first horizontal comparison line and the second horizontal comparison line together, and a vertical reference line having the length obtained by adding the first vertical comparison line and the second vertical comparison line together. The reference line printing instruction unit, instructs the printing unit to print one of the horizontal reference line and the vertical reference line. The reference line length calibration unit, calibrates the length of the horizontal reference line and the length of the vertical reference line. The first comparison line printing instruction unit, instructs the printing unit to print one of the first horizontal comparison line and the first vertical comparison line. The second comparison line printing instruction unit, instructs the printing unit to print the second horizontal comparison line on the same horizontal line as the first horizontal comparison line or to print the second vertical comparison line on the same vertical line as the first vertical comparison line. The comparison line length calibration unit, calibrates the length of the horizontal comparison line from one end of the first horizontal comparison line printed to one end of the second horizontal comparison line printed, or calibrates the length from one end of the first vertical comparison line printed to one end of the second vertical comparison line printed. The length subtraction unit, subtracts the length of the horizontal comparison line from the length of the horizontal reference line or subtracts the length of the vertical comparison line from the length of the horizontal reference line and outputs a subtraction result as the length of errors in image alignment.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
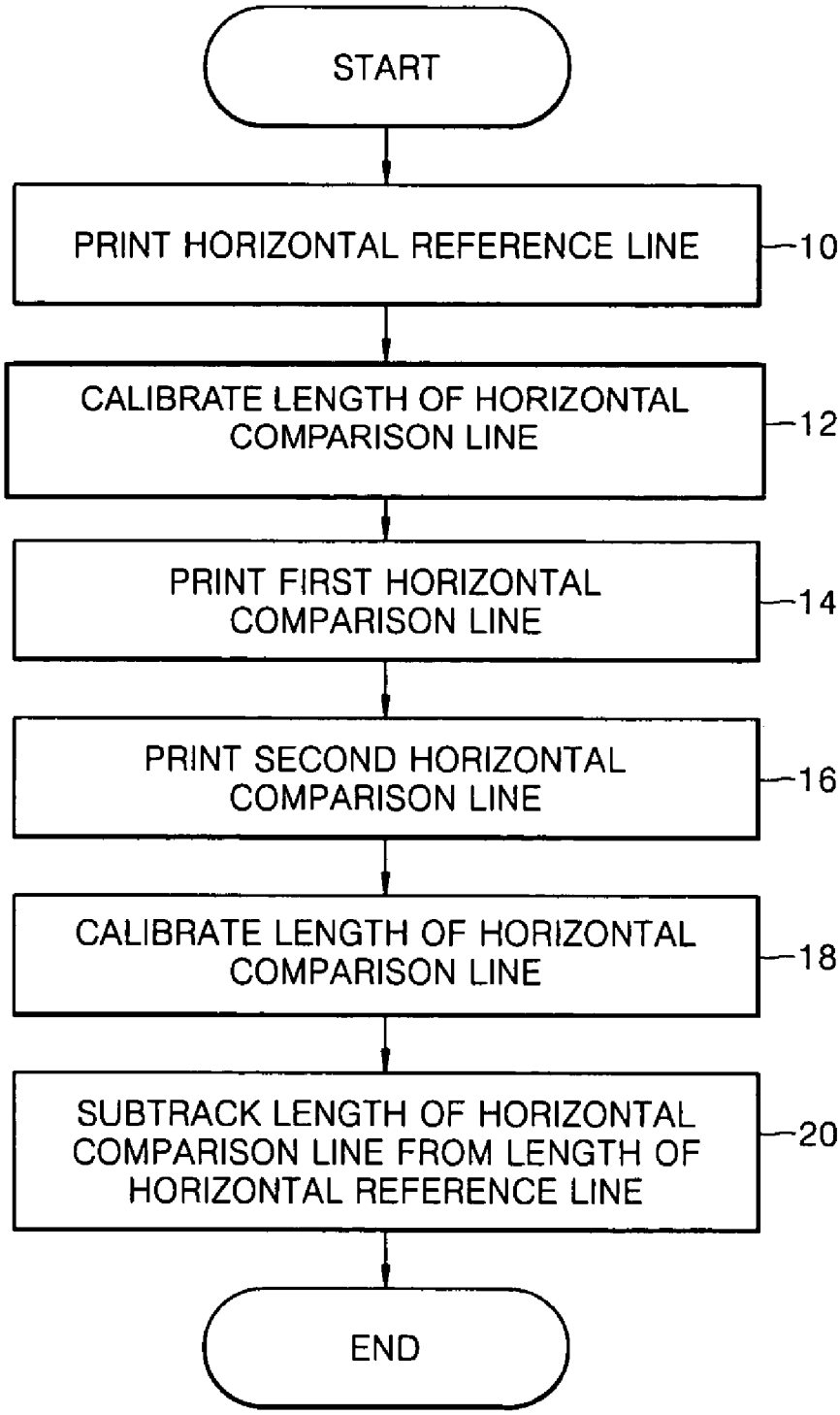
FIG. 1 is a flowchart illustrating a method of calibrating image alignment errors according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

A method of calibrating image alignment errors according to the present invention is now described in detail with reference to the attached drawings.

Figure 2A:
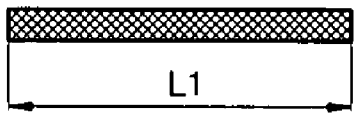
FIGS. 2A through 2C illustrate a horizontal reference line and first and second horizontal comparison lines, for explaining the method of calibrating the image alignment errors shown in FIG. 1.
Figure 2B:
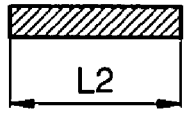
Figure 2C:
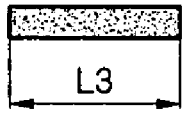
Figure 3:
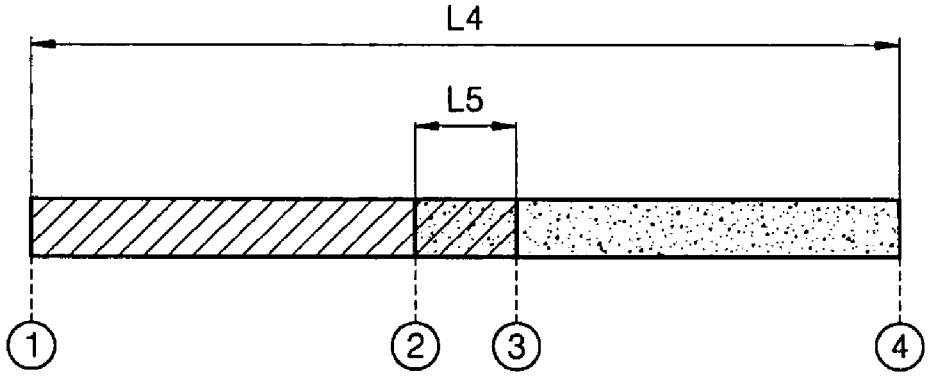
FIG. 3 illustrates a state where the first and second horizontal comparison lines shown in FIG. 2 are printed.

FIG. 1 is a flowchart illustrating a method of calibrating image alignment errors according to an embodiment of the present invention. The method of calibrating image alignment errors comprises operations 10 through 20 of subtracting the length of a horizontal comparison line from the length of a horizontal reference line. FIGS. 2A through 2C illustrate a horizontal reference line and first and second horizontal comparison lines, for explaining the method of calibrating image alignment errors shown in FIG. 1, and FIG. 3 illustrates a state where the first and second horizontal comparison lines shown in FIG. 2 are printed.

In operation 10, a horizontal reference line having the length obtained by adding lengths of first and second horizontal comparison lines together, is printed. In order to calibrate errors in image alignment on a horizontal axis, the horizontal reference line is placed on a horizontal axis and has the length of a reference length. The horizontal reference line has the length obtained by adding the lengths of the first and second horizontal comparison lines together. In order to calibrate errors in image alignment on the horizontal axis, the first and second horizontal comparison lines are provided to be compared with the length of the horizontal reference line. The horizontal reference line is printed in one printing mode so that errors do not occur in the image alignment. In this case, the horizontal reference line may be printed at one time or several times. FIG. 2A illustrates the horizontal reference line, and FIGS. 2B and 2C illustrate the first and second horizontal comparison lines, respectively. The length of the horizontal reference line shown in FIG. 2A is L1, and the length of the first horizontal comparison line shown in FIG. 2B is L2, and the length of the second horizontal comparison line shown in FIG. 2C is L3. Accordingly, $L1=L2+L3$. It is desirable that the length of the first horizontal comparison line and the length of the second horizontal comparison line are half of the length of the horizontal reference line, respectively. That is, $L2=L3=L1\times\frac{1}{2}$.

After operation 10, in operation 12, the length of the horizontal reference line is calibrated. That is, as shown in FIG. 2A, L1, which is the length of the horizontal reference line, is calibrated.

After operation 12, in operation 14, the first horizontal comparison line is printed. That is, as shown in FIG. 2B, the first horizontal comparison line is printed. The first horizontal comparison line may be printed in a single color of black but may be printed in other colors. The first horizontal comparison line is printed in a printing mode to be calibrated.

After operation 14, in operation 16, the second horizontal comparison line is printed in a printing mode to be calibrated on the same horizontal line as the first horizontal comparison line. The second horizontal comparison line may be printed in the same printing mode as the first horizontal comparison line but may be printed in printing modes different from the printing mode of the first horizontal comparison line. The second horizontal comparison line is printed on the same line as the line on which the first horizontal comparison line is printed. The second horizontal comparison line may be printed in a single color of black but may be printed in other colors. The second horizontal comparison line may be printed in the same color as or colors different from the first horizontal comparison line.

In addition, the second horizontal comparison line may be printed in the same direction as a printing direction of the first horizontal comparison line but may be printed in a direction opposite to the printing direction of the first horizontal comparison line. That is, the second horizontal comparison line may be printed in the same direction as the printing direction of the first horizontal comparison line when printing in a single direction or may be printed in a direction opposite to the printing direction of the first horizontal comparison line when printing in two directions.

During a printing operation, starting printing positions of the first and second horizontal comparison lines are determined so that the length obtained by adding the first and second horizontal comparison lines together is the same as the length of the horizontal reference line. The starting printing positions are determined to be the same as the length obtained by adding the first and second horizontal comparison lines together, but during an actual printing operation, errors occur in image alignment due to numerous factors described in related art such that the length of the horizontal reference line is different from the length obtained by adding the first and second horizontal comparison lines together.

FIG. 3 illustrates a state where the first and second horizontal comparison lines shown in FIG. 2 are printed. If the second horizontal comparison line is printed ideally, (3) which corresponds to one end of the first horizontal comparison line, should be identical with (2) which corresponds to one end of the second horizontal comparison line. However, due to the errors in image alignment, a difference in length occurs.

After operation 16, in operation 18, the length of the horizontal comparison line from one end of the first horizontal comparison line printed to one end of the second horizontal comparison line printed is calibrated. In other words, as shown in FIG. 3, a horizontal comparison length L4, which is the length from (1) corresponding to one end of the first horizontal comparison line to (4) corresponding to one end of the second horizontal comparison line, is calibrated.

After operation 18, in operation 20, the length of the horizontal comparison line is subtracted from the length of the horizontal reference line. The subtracted length is determined as the length of errors in image alignment. In other words, L5, which corresponds to the length obtained by subtracting the length L4 of the horizontal comparison line shown in FIG. 3 from the length L1 of the horizontal reference line shown in FIG. 2A, is used as the length of errors to be corrected to result in correct image alignment.

Figure 4:
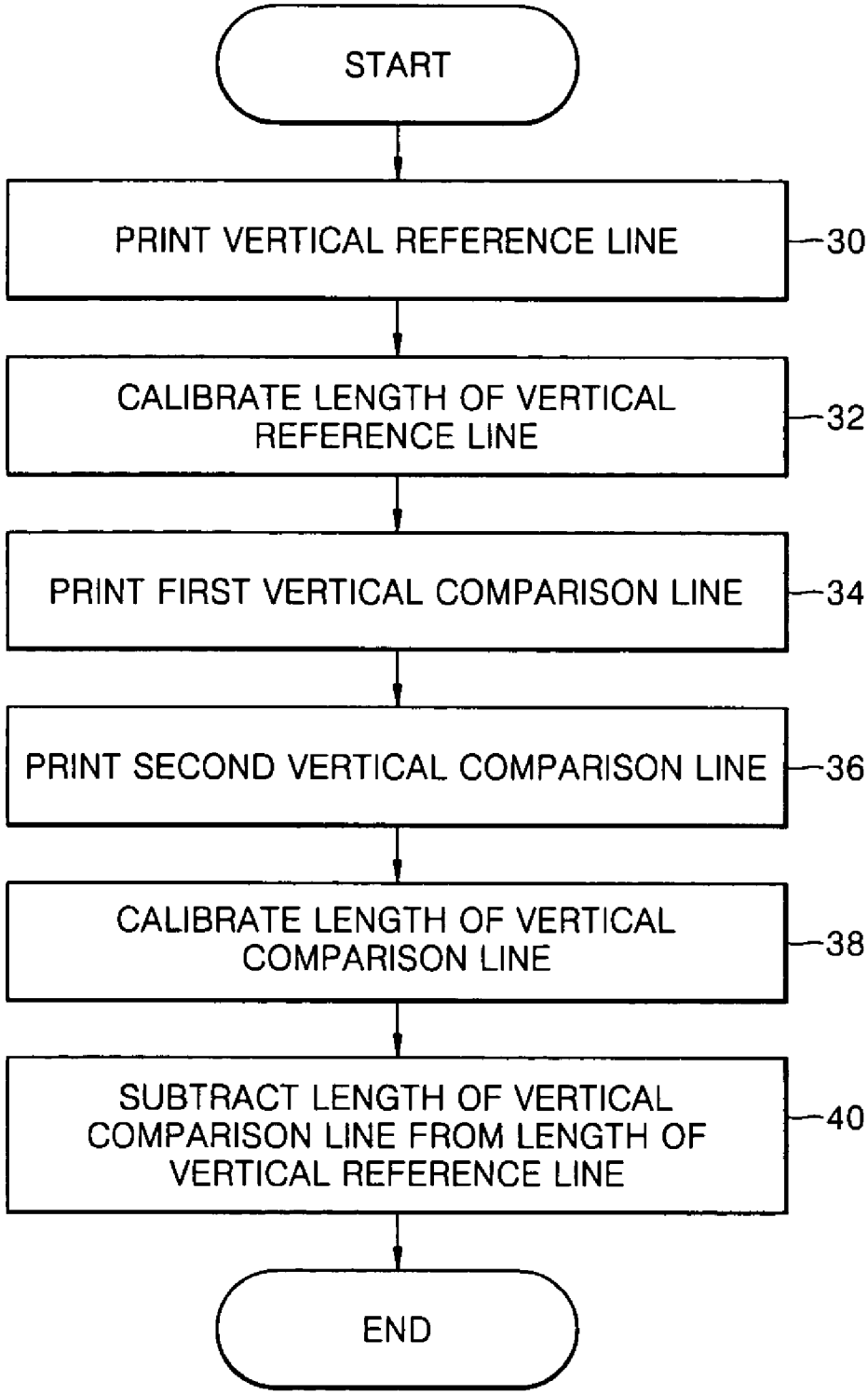
FIG. 4 is a flowchart illustrating a method of calibrating image alignment errors according to an embodiment of the present invention.
Figure 5A:
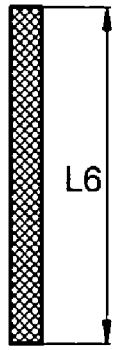
FIGS. 5A through 5C illustrate a vertical reference line and first and second vertical comparison lines, for explaining the method of calibrating the image alignment errors shown in FIG. 4.
Figure 5B:
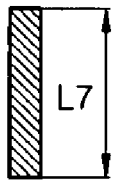
Figure 5C:
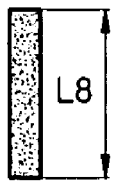
Figure 6:
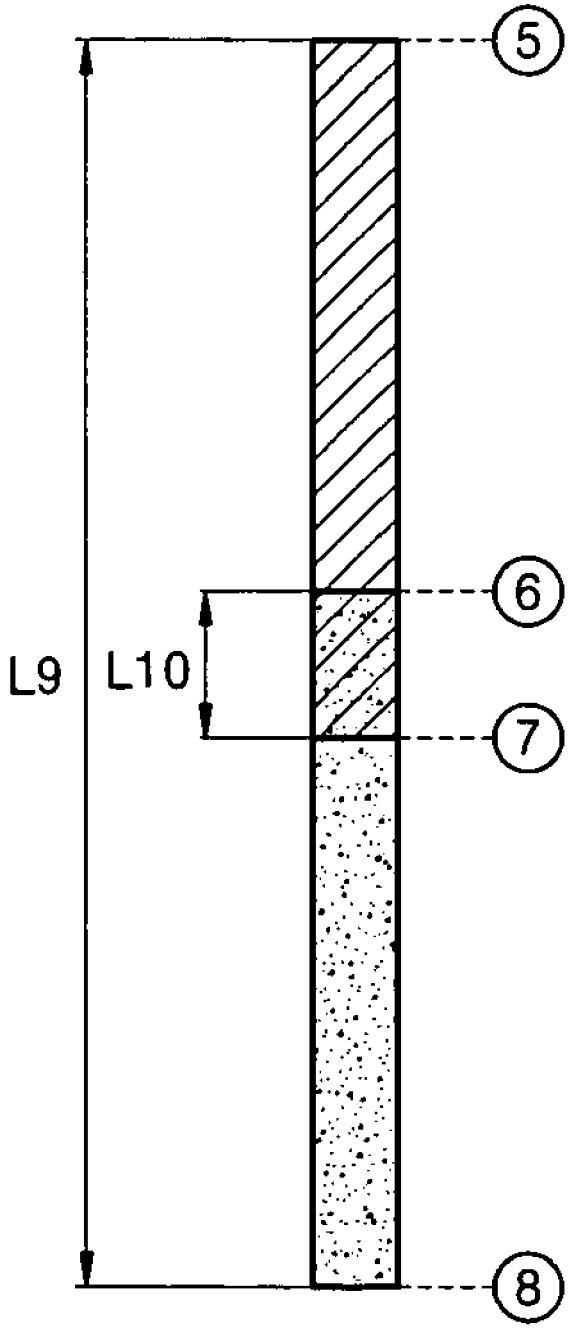
FIG. 6 illustrates a state where the first and second vertical comparison lines shown in FIG. 5 are printed.

FIG. 4 is a flowchart illustrating a method of calibrating image alignment errors according to an embodiment of the present invention. The method of calibrating image alignment errors includes operations 30 through 40 of subtracting the length of a vertical comparison line from the length of a vertical reference line. FIGS. 5A through 5C illustrate a vertical reference line and first and second vertical comparison lines, for explaining a method of calibrating image alignment errors shown in FIG. 4, and FIG. 6 illustrates a state where the first and second vertical comparison lines shown in FIG. 5 are printed.

In operation 30, a vertical reference line having the length obtained by adding lengths of first and second vertical comparison lines together, is printed. In order to calibrate errors in image alignment on a vertical axis, the vertical reference line is placed on a vertical axis and has the length of a reference length. In order to calibrate errors in image alignment on the vertical axis, the first and second vertical comparison lines are printed to be compared with the length of the vertical reference line. The vertical reference line is printed in one printing mode so that errors do not occur in image alignment. The vertical reference line may be printed once or several times. FIG. 5A illustrates the vertical reference line, and FIGS. 5B and 5C illustrate the first and second vertical comparison lines, respectively. The length of the vertical reference line shown in FIG. 5A is L6, and the length of the first vertical comparison line shown in FIG. 5B is L7, and the length of the second vertical comparison line shown in FIG. 5C is L8. Accordingly, the equation is L6=L7+L8. The length of the first vertical comparison line and the length of the second vertical comparison line are half of the vertical reference line, respectively. That is, L7=L8=L6×½. However, it is understood that other configurations of L6 and L8 that add up to L6 may be used.

After operation 30, in operation 32, the length of the vertical reference line is calibrated. That is, as shown in FIG. 5A, L6, which is the length of the vertical reference line, is calibrated.

After operation 32, in operation 34, the first vertical comparison line is printed. That is, as shown in FIG. 5B, the first vertical comparison line is printed. The first vertical comparison line is printed in a single color of black but may be printed in other colors.

After operation 34, in operation 36, the second vertical comparison line is printed in a printing mode to be calibrated on the same vertical line as the first vertical comparison line. The second vertical comparison line is printed on the same line as the line on which the first vertical comparison line is printed. The second vertical comparison line is printed in a single color of black but may be printed in other colors. The second vertical comparison line may be printed in the same color as or in different colors from the first vertical comparison line.

FIG. 6 illustrates a state where the second vertical comparison line is superimposed on a part of the first vertical comparison line that has previously been printed. If the second vertical comparison line is printed ideally, (7) which corresponds to one end of the first vertical comparison line, should be identical with (6), which corresponds to one end of the second vertical comparison line. However, due to the errors in image alignment, a difference in length occurs.

After operation 36, in operation 38, the length of the vertical comparison line from one end of the printed first vertical horizontal comparison line to one end of the printed second vertical comparison line is calibrated. In other words, as shown in FIG. 6, a vertical comparison length L9, which is the length from (5) corresponding to one end of the first vertical comparison line to (8) corresponding to one end of the second vertical comparison line, is calibrated.

After operation 38, in operation 40, the length of the vertical comparison line is subtracted from the length of the vertical reference line. The subtracted length is determined as the length of errors in image alignment on a vertical axis. In other words, L10, which corresponds to the length obtained by subtracting the length L9 of the vertical comparison line shown in FIG. 6 from the length L6 of the vertical reference line shown in FIG. 5A, is used as the length of errors to be corrected for correct image alignment. When the ink-jet printer performs a printing operation in a predetermined printing mode, the error length L10 is applied when ink nozzles or paper stop positions are selected, and alignment errors are thereby corrected.

Hereinafter, an apparatus for calibrating image alignment errors according to the present invention will be described in detail with reference to the attached drawings.

Figure 7:
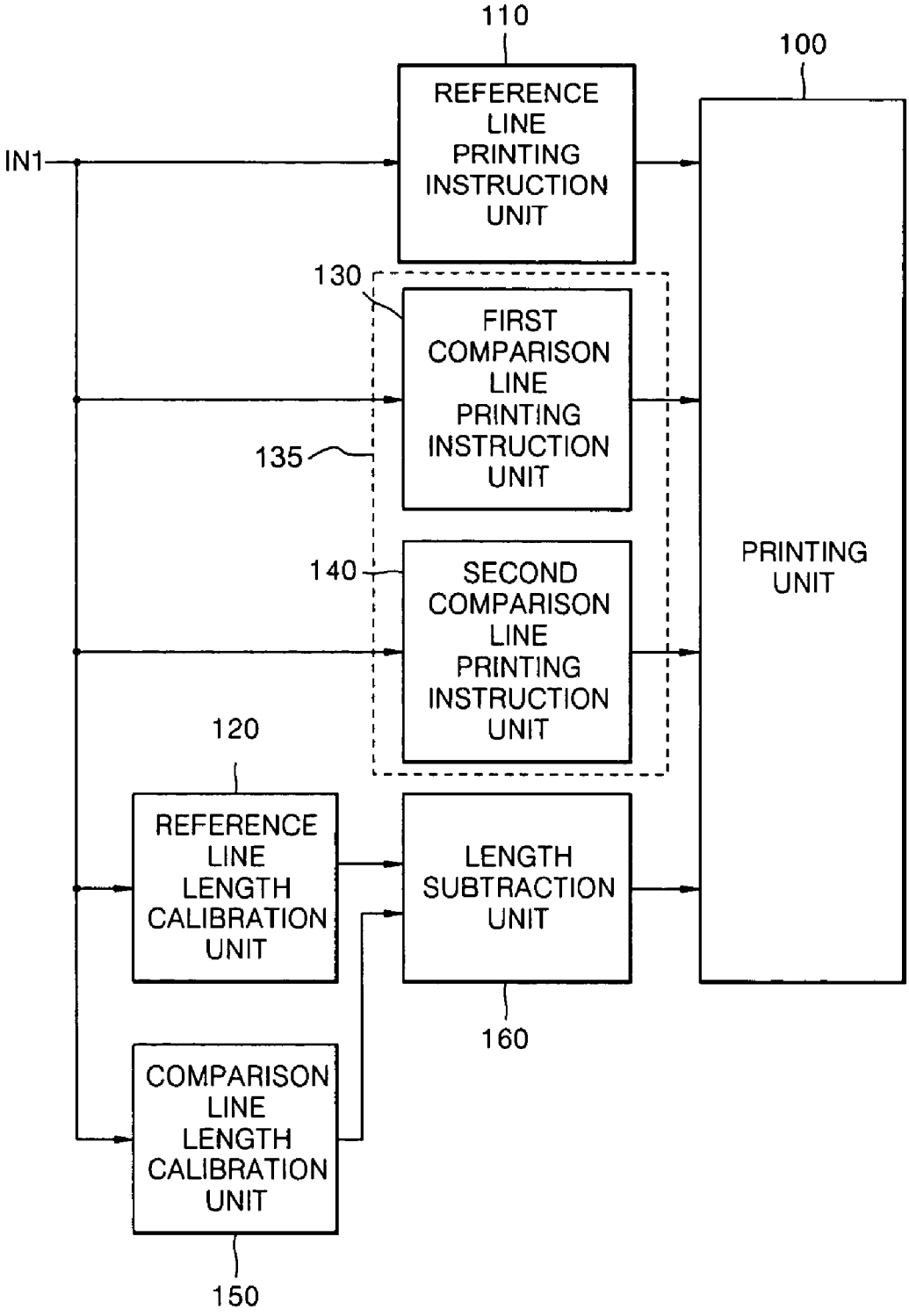
FIG. 7 is a block diagram illustrating an apparatus for calibrating image alignment errors according to an embodiment of the present invention.

FIG. 7 is a block diagram illustrating an apparatus for calibrating image alignment errors according to an embodiment of the present invention. The apparatus for calibrating image alignment errors includes a printing unit 100, a reference line printing instruction unit 110, a reference line length calibration unit 120, a first comparison line printing instruction unit 130, a second comparison line printing instruction unit 140, a comparison line length calibration unit 150, and a length subtraction unit 160.

The printing unit 100 prints a first horizontal comparison line, a second horizontal comparison line, a first vertical comparison line, a second vertical comparison line, a horizontal reference line having a length obtained by adding the first horizontal comparison line and the second horizontal comparison line together, or a vertical reference line having a length obtained by adding the first vertical comparison line and the second vertical comparison line together, and outputs the printing results. Descriptions of the horizontal reference line, the first horizontal comparison line, the second horizontal comparison line, the vertical reference line, the first vertical comparison line, and the second vertical comparison line are the same as those described previously, and thus, will be omitted.

The printing unit 100 performs a printing operation according to printing instructions input by the reference line printing instruction unit 110, the first comparison line printing instruction unit 130, or the second comparison line printing instruction unit 140. In this case, instructions to be transmitted in accordance with different printing modes include information necessary for the printing operation. The information has information on images to be printed, starting positions of printing, printing directions, and printing colors.

The printing unit 100 receives a reference line printing instruction signal from the reference line printing instruction unit 110, which causes the printing unit 100 to print one of the horizontal reference line and the vertical reference line. The printing unit 100 receives a first comparison line printing instruction signal from the first comparison line printing instruction unit 130, which instructs the printing unit 100 to print one of the first horizontal comparison line and the first vertical comparison line. The printing unit 100 receives a second comparison line printing instruction signal from the second comparison line printing instruction unit 140, which instructs the printing unit 100 to print the second horizontal comparison line or the second vertical comparison line.

Meanwhile, the printing unit 100 can print the first horizontal comparison line, the second horizontal comparison line, the first vertical comparison line, or the second vertical comparison line in black or other colors.

The reference line printing instruction unit 110 instructs the printing unit 100 to print the horizontal reference line or the vertical reference line and outputs an instruction result to the printing unit 100 as a reference line printing instruction signal in response to an error calibration image alignment request signal input through an input terminal IN1. In this case, the reference line printing instruction unit 110 outputs the reference line printing instruction signal and simultaneously outputs information in accordance with different printing modes.

The reference line length calibration unit 120 calibrates the length of the horizontal reference line or the length of the vertical reference line and outputs a calibration result to the length subtraction unit 160 as a reference line calibration signal in response to the error calibration image alignment request signal input through the input terminal IN1. The reference line length calibration unit 120 may be implemented with an optical sensor (not shown) and an analog to digital converter (ADC) (not shown). The optical sensor having a light emitting unit and a light receiving unit scans a printed image, converts the printed image into a voltage value according to a sensed light amount, and outputs the voltage value. The voltage value converted by the optical sensor is converted by the ADC. The length of a black color portion, a white color portion, or other color portions can be calculated according to the level of the digital voltage value.

The first comparison line printing instruction unit 130 instructs the printing unit 100 to print the first horizontal comparison line or the first vertical comparison line and outputs an instruction result to the printing unit 100 as a first comparison line printing instruction signal in response to the error calibration image alignment request signal input through the input terminal IN1. In this case, the first comparison line printing instruction unit 130 outputs the first comparison line printing instruction signal and simultaneously outputs information in accordance with different printing modes. The first comparison line printing instruction unit 130 instructs the printing unit 100 to print the first horizontal comparison line or the first vertical comparison line in black or other colors.

The second comparison line printing instruction unit 140 instructs the printing unit 100 to print the second horizontal comparison line on the same horizontal line as the first horizontal comparison line, or to print the second vertical comparison line on the same vertical line as the first vertical comparison line, and outputs an instruction result to the printing unit 100 as a second comparison line printing instruction signal in response to the error calibration image alignment requiring signal input through the input terminal IN1. In this case, the second comparison line printing instruction unit 140 outputs the second comparison line printing instruction signal and simultaneously outputs information in accordance with different printing modes. The second comparison line printing instruction unit 140 instructs the printing unit 100 to print the second horizontal comparison line or the second vertical comparison line in black or other colors. The second comparison line printing instruction unit 140 may instruct the printing unit 100 to print the second horizontal comparison line in the same direction as a printing direction of the first horizontal comparison line or to print the second horizontal comparison line in a direction opposite to the printing direction of the first horizontal comparison line.

Alternatively, the first comparison line printing instruction unit 130 and the second comparison line printing instruction unit 140 may be combined into a comparison line printing instruction unit 135 that would handle both line printing instructions.

The comparison line length calibration unit 150 calibrates the length of the horizontal comparison line from one end of the printed first horizontal comparison line to one end of the printed second horizontal comparison line, or calibrates the length of the vertical comparison line from one end of the printed first vertical comparison line to one end of the printed second vertical comparison line, and outputs a calibration result to the length subtraction unit 160 as a comparison line calibration signal.

The comparison line length calibration unit 150 may be implemented with an optical sensor (not shown) and an analog to digital converter (ADC) (not shown), like in the reference line length calibration unit 120. The detailed structure and operation of the optical sensor and the ADC are the same as those described previously, and thus, will be omitted.

As shown in FIG. 3, the comparison line length calibration unit 150 calibrates the length L4 of the horizontal comparison line, which corresponds to the length from (1) corresponding to one end of the first horizontal comparison line to (4) corresponding to one end of the second horizontal comparison line. In addition, as shown in FIG. 6, the comparison line length calibration unit 150 calibrates the length L9, which corresponds to the length from (5) corresponding to one end of the first vertical comparison line to (8) corresponding to one end of the second vertical comparison line.

The length subtraction unit 160 subtracts the length of the horizontal comparison line from the length of the horizontal reference line or subtracts the length of the vertical comparison line from the length of the horizontal reference line and outputs a subtraction result to the printing unit 100 as the length of errors in image alignment in response to the reference line calibration signal and the comparison calibration signal. The length subtraction unit 160 receives the reference line calibration signal from the reference line length calibration unit 120 and receives the comparison line calibration signal from the comparison line length calibration unit 150. In the present invention, both the vertical and horizontal operations may be performed separately or during the same print operation.

As shown in FIG. 3, the length of errors subtracted by the length subtraction unit 160 corresponds to the length L5 of a portion in which the first horizontal comparison line and the second horizontal comparison line are superimposed. As shown in FIG. 6, the length of errors subtracted by the length subtraction unit 160 corresponds to the length L10 of a portion in which the first vertical comparison line and the second vertical comparison line are superimposed.

The printing unit 100 stores the length of errors in image alignment on a horizontal axis or the length of errors in image alignment on a vertical axis of an image input in accordance with different printing modes selected from the length subtraction unit 160. During a standard printing operation, the printing unit 100 performs a correction operation, such as starting positions of printing, delaying the speed of ink ejection, selecting ink nozzles or paper stop positions using information on the length of errors in image alignment on the horizontal axis or the length of errors in image alignment on the vertical axis.

As described above, in the method and apparatus for calibrating image alignment errors according to the present invention, even though a user does not check with the naked eye for errors in image alignment and does not select vertical or horizontal test patterns having good alignment states, errors in image alignment can be easily calibrated, so that errors in image alignment can be automatically calibrated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of calibrating image alignment errors performed by an ink-jet printer, so as to correct errors in image alignment on a horizontal or vertical axis, the method comprising:

printing a horizontal reference line having a length obtained by adding a first horizontal comparison line and a second horizontal comparison line together;

calibrating the length of the horizontal reference line;

printing the first horizontal comparison line;

printing the second horizontal comparison line on the same horizontal line as the first horizontal comparison line;

calibrating a length of a horizontal comparison line from one end of the printed first horizontal comparison line to one end of the printed second horizontal comparison line; and subtracting the length of the horizontal comparison line from the length of the horizontal reference line, and wherein a subtracted length is determined as a length of errors in image alignment.

2. The method of claim 1, wherein the length of the first horizontal comparison line and the length of the second horizontal comparison line are each half of the length of the horizontal reference line.

3. The method of claim 1, wherein the first horizontal comparison line is printed in one of black and another color.

4. The method of claim 1, wherein the second horizontal comparison line is printed in one of the same color as the first horizontal comparison line and in another color.

5. The method of claim 1, wherein the second horizontal comparison line is printed in the same direction as a printing direction of the first horizontal comparison line.

6. The method of claim 1, wherein the second horizontal comparison line is printed in a direction opposite to a printing direction of the first horizontal comparison line.

7. A method of calibrating image alignment errors performed by an ink-jet printer, so as to correct errors in image alignment on a horizontal or vertical axis, the method comprising:

printing a vertical reference line having a length obtained by adding a first vertical comparison line and a second vertical comparison line together;

calibrating the length of the vertical reference line;

printing the first vertical comparison line;

printing the second vertical comparison line on the same vertical line as the first vertical comparison line;

calibrating a length of a vertical comparison line from one end of the printed first vertical comparison line to one end of the printed second vertical comparison line; and subtracting the length of the vertical comparison line from the length of the vertical reference line, wherein the subtracted length is determined as a length of errors in image alignment.

8. The method of claim 7, wherein the length of the first vertical comparison line and the length of the second vertical comparison line are each half of the length of the vertical reference line.

9. The method of claim 7, wherein the first vertical comparison line is printed in one of black and another color.

10. The method of claim 7, wherein the second vertical comparison line is printed in one of the same color as the first vertical comparison line and in another color.

11. An apparatus for calibrating image alignment errors performed by an ink-jet printer, so as to correct errors in image alignment on a horizontal and vertical axis, the apparatus comprising:

a printing unit, which prints one of a first horizontal comparison line, a second horizontal comparison line, a first vertical comparison line, a second vertical comparison line, a horizontal reference line having a length obtained by adding the first horizontal comparison line and the second horizontal comparison line together, and a vertical reference line having a length obtained by adding the first vertical comparison line and the second vertical comparison line together;

a reference line printing instruction unit, which instructs the printing unit to print one of the horizontal reference line and the vertical reference line;

a reference line length calibration unit, which calibrates the length of the horizontal reference line and the length of the vertical reference line;

a first comparison line printing instruction unit, which instructs the printing unit to print one of the first horizontal comparison line and the first vertical comparison line;

a second comparison line printing instruction unit, which instructs the printing unit to print one of the second horizontal comparison line on the same horizontal line as the first horizontal comparison line and to print the second vertical comparison line on the same vertical line as the first vertical comparison line;

a comparison line length calibration unit, which calibrates a length of one of the horizontal comparison line from one end of the first horizontal comparison line printed to one end of the second horizontal comparison line printed, and calibrates the length from one end of the first vertical comparison line printed to one end of the second vertical comparison line printed; and a length subtraction unit, which subtracts one of the length of the horizontal comparison line from the length of the horizontal reference line and subtracts the length of the vertical comparison line from the length of the horizontal reference line and outputs a subtraction result as a length of errors in image alignment.

12. The apparatus of claim 11, wherein the length of the first horizontal comparison line and the length of the second horizontal comparison line are each half of the horizontal reference line and the length of the first vertical comparison line and the length of the second vertical comparison line are each half of the vertical reference line.

13. The apparatus of claim 12, wherein the first comparison line printing instruction unit instructs the printing unit to print the first horizontal comparison line in one of black and another color.

14. The apparatus of claim 11, wherein the second comparison line printing instruction unit instructs the printing unit to print the second horizontal comparison line in one of the same color as the first horizontal comparison line and in another color and to print the second vertical comparison line in one of the same color as the first vertical comparison line and in another colors.

15. The apparatus of claim 11, wherein the second comparison line printing instruction unit instructs the printing unit to print the second horizontal comparison line in the same direction as a printing direction of the first horizontal comparison line.

16. The apparatus of claim 11, wherein the second comparison line printing instruction unit instructs the printing unit to print the second horizontal comparison line in a direction opposite to a printing direction of the first horizontal comparison line.

17. An image alignment calibration method comprising:

printing a first reference line having a first predetermined length;

printing a first comparison line having a second predetermined length;

printing a second comparison line having a third predetermined length aligned with the first comparison line, wherein a total comparison line is defined as a length from a first end of the printed first comparison line to a distal end of the printed second comparison line;

determining a length of the printed first reference line;

determining a length of the total comparison line; and determining an image alignment error length based upon a difference between the length of the printed first reference line and the length of the total comparison line.

18. The method of claim 17, wherein the reference line and the total comparison line is vertically oriented.

19. The method of claim 17, wherein the reference line and the total comparison line are horizontally oriented.

20. The method of claim 17, wherein the first predetermined length of the first reference line is the second predetermined length added to the third predetermined length.

21. The method of claim 20, wherein the second and third predetermined lengths are equal.

22. An image alignment calibration device comprising:

a printing unit;

a reference line printing unit to output a signal to the printing unit to print a reference line having a first predetermined length in response to an image alignment request signal;

a comparison line printing unit to output a signal to the printing unit to print a first comparison line having a second predetermined length and a second comparison line having a third predetermined length, wherein the printed first and second comparison line are contiguous and define a printed comparison line;

a length calibration unit to measure a length of a printed reference line, and a length of a printed comparison line; and a subtraction unit to determine an image alignment error length based upon a difference between the length of the printed reference line and the length of the printed comparison line.

23. The device of claim 22, wherein the first predetermined length is the second predetermined length and the third predetermined length added together.

24. The device of claim 23, wherein the second predetermined length is equal to the third predetermined length.

* * * * *